US006635815B2

(12) United States Patent
Kosakaya et al.

(10) Patent No.: US 6,635,815 B2
(45) Date of Patent: Oct. 21, 2003

(54) ELECTRONIC MUSIC PROVIDING APPARATUS

(75) Inventors: Juichi Kosakaya, Hitachi (JP); Isao Arai, Hitachinaka (JP); Masumi Kizaki, Hitachi (JP)

(73) Assignee: Hitachi Car Engineering Co., Ltd., Hitachi (JP)

( * ) Notice: Subject to any disclaimer, the term of this patent is extended or adjusted under 35 U.S.C. 154(b) by 0 days.

(21) Appl. No.: 09/998,127

(22) Filed: Dec. 3, 2001

(65) Prior Publication Data

US 2002/0066357 A1 Jun. 6, 2002

(30) Foreign Application Priority Data

Dec. 1, 2000 (JP) ..... 2000-367329
Oct. 4, 2001 (JP) ..... 2001-308621

(51) Int. Cl.[7] ..... G09B 15/06
(52) U.S. Cl. ..... 84/471 R; 84/477 R
(58) Field of Search ..... 84/470 R, 477 R, 84/471 R, 464 R, 464 A

(56) References Cited

U.S. PATENT DOCUMENTS 5,760,323 A * 6/1998 Romero et al. ..... 84/470 R
6,084,168 A * 7/2000 Sitrick ..... 84/477 R
6,156,964 A * 12/2000 Sahai et al. ..... 84/470 R
6,348,648 B1 * 2/2002 Connick, Jr. ..... 84/477 R
6,380,471 B2 * 4/2002 Matsumoto ..... 84/477 R

FOREIGN PATENT DOCUMENTS

JP 05-073042 3/1993
JP 10-254434 9/1998
JP 2000-231379 8/2000

* cited by examiner

*Primary Examiner*—Jeffrey Donels
(74) *Attorney, Agent, or Firm*—Crowell & Moring LLP

(57) ABSTRACT

The electronic music providing apparatus comprises a music control unit which inputs score data, classifies the score data into music data of each play part, and transmits it, and an electronic music display unit which receives music data of each music part, stores it, displays the stored music, and turns music pages according to music display control data signal from said music control unit and other electronic music display units of the same part.

11 Claims, 12 Drawing Sheets

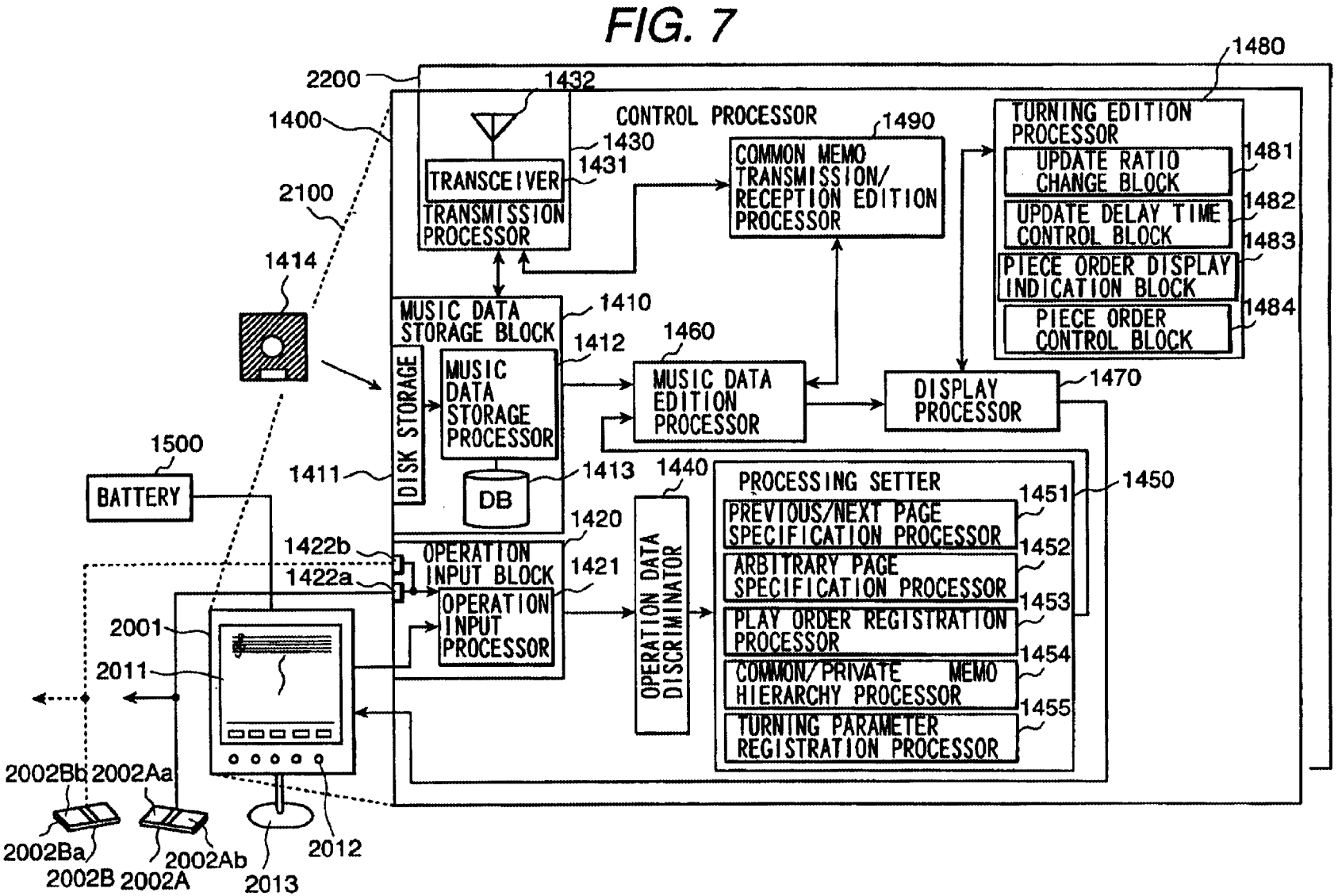
FIG. 7
CONTROL PROCESSOR
TURNING EDITION PROCESSOR
UPDATE RATIO CHANGE BLOCK
UPDATE DELAY TIME CONTROL BLOCK
PIECE ORDER DISPLAY INDICATION BLOCK
PIECE ORDER CONTROL BLOCK
DISPLAY PROCESSOR
COMMON MEMO TRANSMISSION/ RECEPTION EDITION PROCESSOR
MUSIC DATA EDITION PROCESSOR
PROCESSING SETTER
PREVIOUS/NEXT PAGE SPECIFICATION PROCESSOR
ARBITRARY PAGE SPECIFICATION PROCESSOR
PLAY ORDER REGISTRATION PROCESSOR
COMMON/PRIVATE MEMO HIERARCHY PROCESSOR
TURNING PARAMETER REGISTRATION PROCESSOR
OPERATION DATA DISCRIMINATOR
TRANSCEIVER
TRANSMISSION PROCESSOR
MUSIC DATA STORAGE BLOCK
MUSIC DATA STORAGE PROCESSOR
DISK STORAGE
DB
OPERATION INPUT BLOCK
OPERATION INPUT PROCESSOR
BATTERY
1480
1481
1482
1483
1484
1470
1450
1451
1452
1453
1454
1455
1490
1460
1440
1430
1431
1432
1410
1412
1413
1420
1421
1422a
1422b
1411
1414
2200
1400
2100
2012
2013
2002Ab
2002A
2002Aa
2002B
2002Bb
2002Ba
2001
2011
1500

ELECTRONIC MUSIC PROVIDING APPARATUS

BACKGROUND OF THE INVENTION

1. Field of the Invention

The present invention relates to an electronic music providing apparatus.

2. Related Background Art

There have been proposed some electronic music providing apparatus to electronically display music on an image display screen and to turn music pages on the screen according to page turning signals.

An electronic music display unit and a method of displaying electronic music which have been disclosed by Japanese Application Patent Laid-Open Publication No. 2000-231379 enable displaying electronic music on a liquid crystal display panel of the touch-sensitive type and handwriting memo data on electronic music. This invention employs a foot pedal to generate a page turn signal to update music pages on-screen. This invention also arranges music data and handwritten memo data in a tree-like structure for management, which enables addition and deletion of memo data without destroying music data.

An electronic music display apparatus disclosed by Japanese Application Patent Laid-Open Publication No. Hei 05-73042 is so constructed to read music data from a floppy disk set in personal computer, display it on a liquid crystal display panel, and turn music pages on screen forward or backward by a page turn signal generated by operation of a foot switch or a hand switch.

An electronic music instrument disclosed by Japanese Application Patent Laid-Open Publication No. Hei 10-254434 is characterized in that the display screen area is divided into two page areas and that, when music on the former part is completed, the music data on the former part of the current page is updated by music data of the former part of the next page and the latter part of the current page is updated by music data of the latter part of the next page automatically by a time interrupt. It has been proposed that each of the former and latter parts is divided into three areas to update music data in the order.

However, the above conventional electronic music display apparatus and methods still have the problems below unsolved.

The above conventional electronic music display apparatus and methods cannot implement page turning according to the playing technique level of the player or player's taste.

In many cases, memo data as music reference information is written on music. However, this is very time-consuming and troublesome when a lot of music players such as orchestra members write memo data on their own electronic music providing apparatus and this may also cause writing errors.

Further, in a concert which plays a lot of music pieces, it is necessary to select music pieces to be played, put them in order, and cue among them before playing. This is very time-consuming and troublesome.

A mechanism which uses a foot switch or a hand switch to turn music pages is not convenient for a piano player who uses both hands and feet to play.

Further, it is preferable to use some electronic music providing apparatus to display a lot of music or to display music bigger on an image display unit of a limited screen size. However, it is difficult for a single player to operate a few electronic music providing apparatus to turn pages during playing.

Furthermore, image display units usually have a rectangular and flat screen and in some cases, they are preferably placed on their sides or reversed to use. However, in such cases, the content on the screen is sideways or reversed and hard to be recognized.

SUMMARY OF THE INVENTION

It is an object of the present invention to provide a convenient electronic music providing apparatus that can provide proper music to a lot of players such as orchestra members.

It is another object of the present invention to provide a plurality of electronic music displays with music data and to facilitate update (page turning) of music pages on-screen.

It is another object of the present invention to provide an electronic music providing apparatus which enables page turning according to the playing technique level of the player or player's taste.

It is another object of the present invention to provide an electronic music providing apparatus which can send the entered music memo data to another electronic music providing apparatus to display it.

It is yet a further object of the present invention to provide an electronic music providing apparatus which can easily provide electronic pages of music pieces.

It is a more particular object of the present invention to provide an electronic music providing apparatus which can easily instruct to turn music pages.

It is still another object of the present invention to provide an electronic music providing apparatus which can be easily used together with the other electronic music providing apparatus.

It is a further object of the present invention to provide an electronic music providing apparatus which can be oriented freely for optimum legibility.

It is yet another object of the present invention to provide an electronic music providing apparatus which can be used as a player electronic music display unit in the electronic music providing apparatus which the inventors of this patent publication (Japan Patent Publication 2000-367329) had developed and applied for a patent.

The present invention provides an electronic music providing apparatus for displaying stored music data and updating the music pages according to a music display control data signal; wherein said electronic music providing apparatus comprises a music control unit which inputs score data, classifies the score data according to play parts, and transmits it, and an electronic music display unit which receives music data of each play part, stores it, displays the stored music data, and turns music pages according to the music display control data signal from said music page turning means in said electronic music display unit and said music control unit.

Further, the present invention provides an electronic music providing apparatus for displaying stored music data on an image display block and updating the music pages according to a music display control data signal; wherein said electronic music providing apparatus comprises an update ratio setting block which sets and inputs a page turning ratio and a page turning edition processing block which divides music to be displayed on said image display block according to a preset update ratio and edits music data which is updated and displayed at a preset update interval.

The electronic music providing apparatus is equipped with an update delay time control block which sets and inputs said preset update time difference. Said page turning edition processing block updates music in a specified range when said page turn signal is input and turns music pages in the other range at a preset update time later after said page turn signal is entered Further, the electronic music providing apparatus comprises a memo input means which inputs memo data for music, a common/private data hierarchical processing block which separates the entered memo data from music data and hierarchically arranges private memo data (for personals) and common memo data (to be shared by music members) into tree-like structures, a common memo edition processing block which edits common memo data to be sent to the other electronic music providing apparatus, and a transmission processing block which transmits and receives common memo data; wherein the electronic music providing apparatus is designed to transmit the received common memo data to another electronic music providing apparatus.

Further, the electronic music providing apparatus comprises a play order registration processing block which determines an order of playing music pieces and registers it, a music displaying block which displays the registered pieces of music, and a play order control block which checks the playing order of music (for double order registration or invalid order) and shows the top page of music in the next registered order when the last page of the currently-played piece of music comes by calling the music data from the music data storage block.

Further, the electronic music providing apparatus comprises a page turning processing block which determines pages to be turned; wherein said page turning edition processing block updates the music page on the screen according to the preset page update order.

Further, the electronic music providing apparatus is characterized in that a means for generating page turn signals has a plurality of operation switches and said page turning edition processing block turns music pages in response to a page turn signal determined by respective operation switches.

Further, the electronic music providing apparatus comprises a music orientation indicating means which changes the orientation of music relative to said image display block.

BRIEF DESCRIPTION OF DRAWINGS

FIG. 7 is a functional block diagram of an electronic music providing apparatus which is another embodiment of the present invention.

DESCRIPTION OF THE PREFERRED EMBODIMENTS

Below will be explained an embodiment of the present invention.

Figure 1:
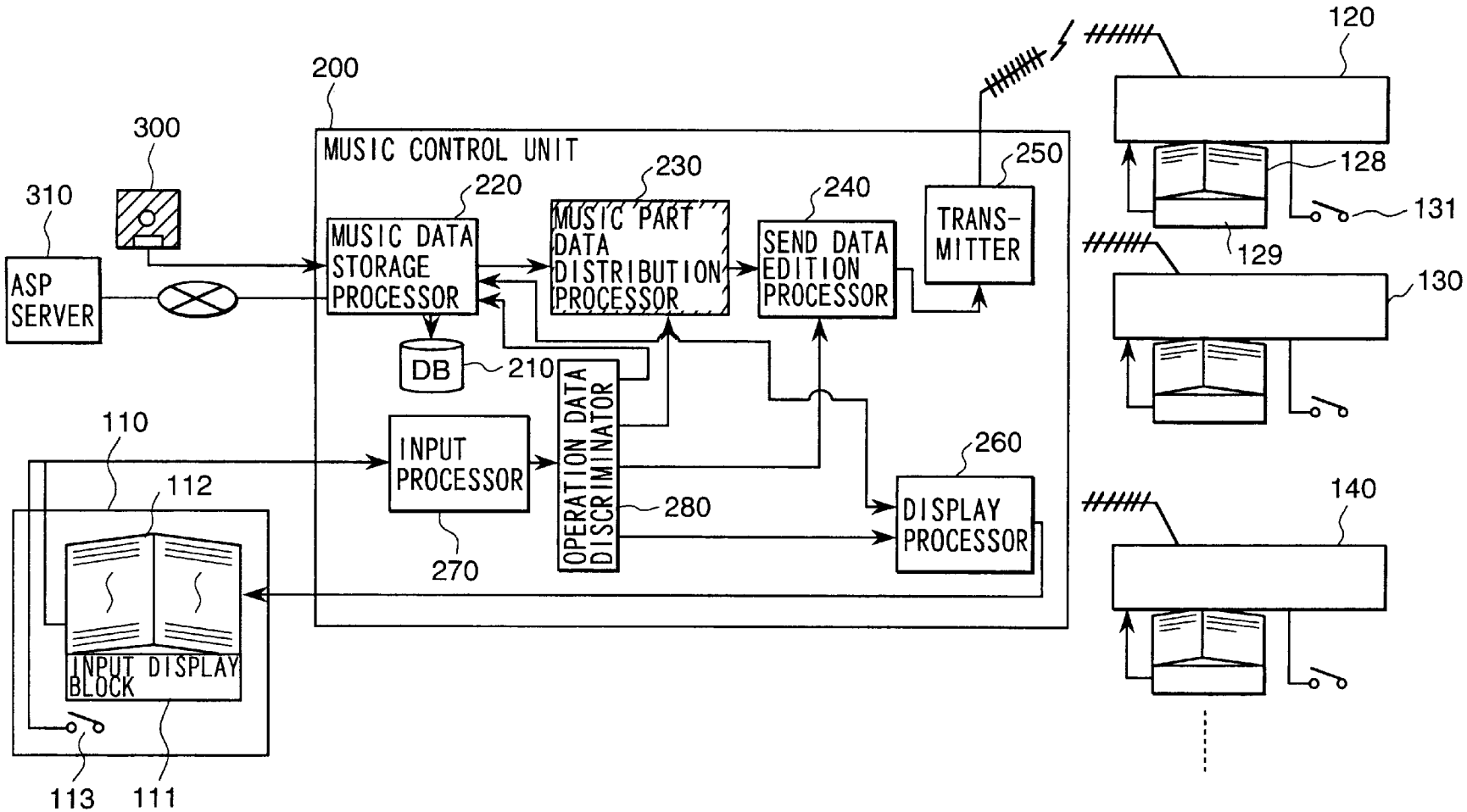
FIG. 1 is a functional block diagram of an electronic music providing apparatus which is an embodiment of the present invention.

FIG. 1 is a functional block diagram of an electronic music providing apparatus which is an embodiment of the present invention and shows the details of a music control unit.

The manager electronic music display 110 is used by a music manager (conductor or other manager) to browse and enter commands and is equipped with a command input display block 111, a music display block (music display area) 112, and a page turning foot switch 113 to input, display, and distribute a score and update (turn pages) the music pages.

When receiving a command from the manager electronic music display 110, the music control unit 200 loads score information of a selected music from a music data medium 300 (or from Internet through an ASP server 310), stores it, classifies the stored score data into music data for each music instrument (part), sends the music part data to the related player electronic display units 120, 130, 140, and so on to store the data, and instructs the player electronic display units 120, 130, 140, and so on to turn music pages.

For the above purpose, the music control unit 200 comprises a music storage block (DB) 210 which stores music data, a music data storage processor 220 which loads score data of a music from a music data media 300, assigns a storage address to each bar, and stores each music part data in said music storage block 210, a music part data distribution processor 230 which loads music data of each music part data from the music storage block 210 to distribute music part data for respective player electronic display units 120, 130, 140, and so on, assigns identification information to each of them, and edits them into music data dedicated for each music part, a send data edition processor 240 which edits music data for each music part (and identification information), command data, and identification data respectively into 1-packet transmission data format and sends it to the transmitter, a transmitter 250 which transmits data to respective player electronic display units 120, 130, 140, and so on by radio, a display processor 260 which generates music image data to be displayed on the manager electronic display unit 110, an input processor 270 which inputs command data signals from the input display block 111, and an operation data discriminator 280 which discriminates a command data signal coming from the input processor 270 and sends the command data signal to said music data storage processor 220, said music part data distribution processor 230, said send data edition processor 240, and said display processor 260.

Actually, said music storage block 210, said music data storage processor 220, said music part data distribution processor 230, said send data edition processor 240, said display processor 260, said input processors 270, and said operation data discriminator 280 in said music control unit 200 are made up with small computer systems.

Figure 2:
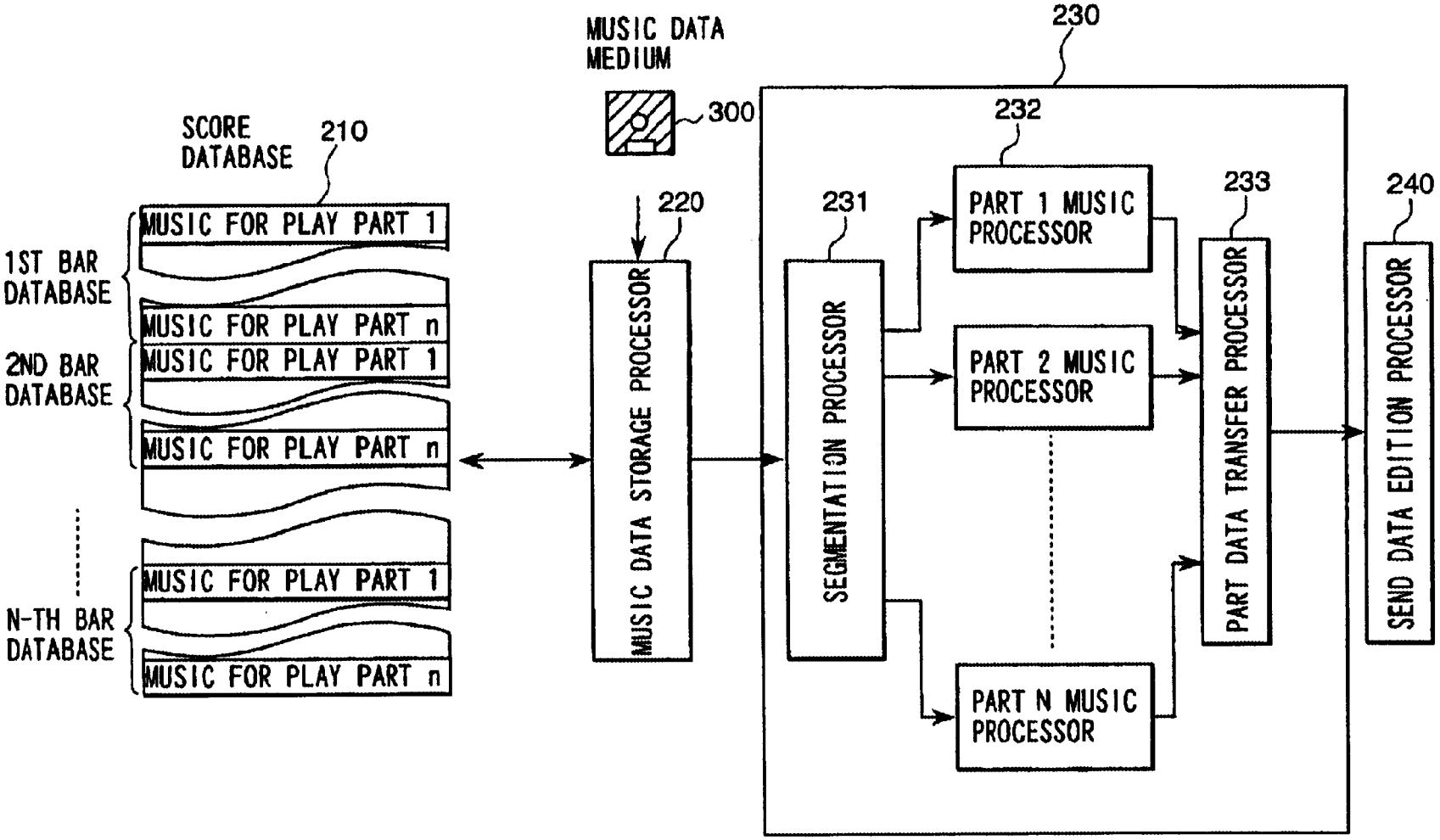
FIG. 2 is a functional block diagram of a music storage block, a music data storage processing block, and a music data distribution processing block for each part in the electronic music providing apparatus of FIG. 1.

Referring to FIG. 2, said music storage block 210, said music data storage processor 220, and said music part data distribution processor 230 will be explained in detail.

Said music data storage processor 220 loads score data from the storage data medium 300, classifies the score data into addresses of bars 1 to n, assigns a detailed address to the content of each bar as a music element for each music part, and stores then in the music storage block 210.

Said music part data distribution processor 230 comprises a segmentation processor 231 which extracts music data of each play part from score data read from the score database 210, part number music processors which edit music data of each music part, and a part data transfer processor 233 which arranges music data of each music part into packets of each music part and sends them to the send data edition processor 240. In summary, said music part data distribution processor 230 arranges music data of each play part into respective packets and outputs it.

The send data edition processor 240 edits music data to be downloaded to respective player electronic display units 120, 130, 140, and so on and music display control data signals such as a page turn command.

Figure 3:
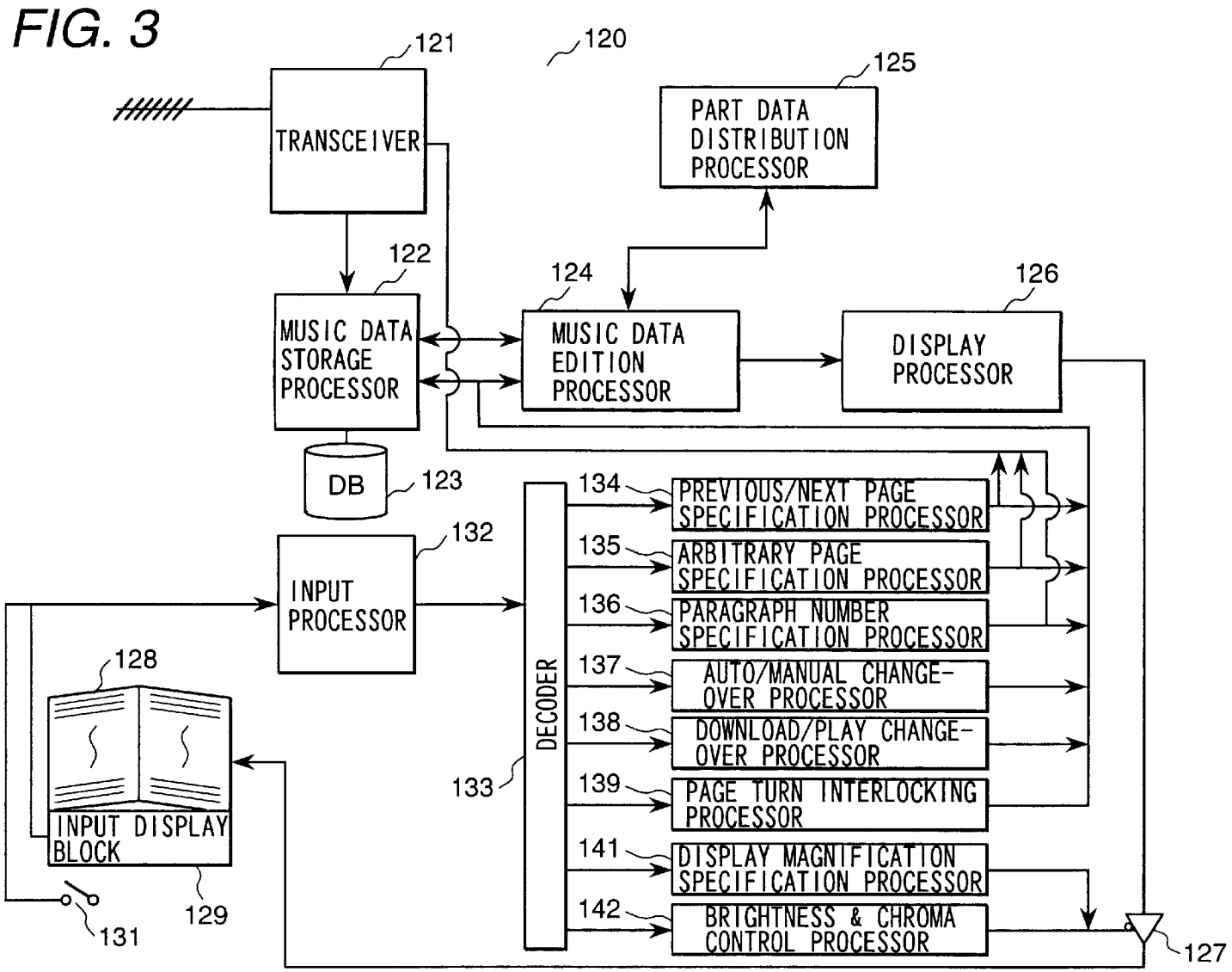
FIG. 3 is a functional block diagram of a player electronic music display unit in the electronic music providing apparatus of FIG. 1.

FIG. 3 is a functional block diagram of the player electronic music display (one of 120, 130, 140, and so on) which is a music regeneration unit. FIG. 3 shows the player electronic music display 120 as an example as the player electronic music displays 120, 130, 140, and so on are all identical in the configuration.

The player electronic music display 120 comprises a transceiver 121, a music data storage processor 122, a music storage block 123, a music data edition processor 124, a part data distribution processor 125, a display processor 126, a 3-state bus driver processor 127, a music display block 128, a command input display block 129, a page turning foot switch 131, an input processor 132, a decoder 133, a Previous/Next page specification processor 134, an arbitrary page specification processor 135, a paragraph number specification processor 136, an Auto/Manual change-over processor 137, a Download/Play change-over processor 138, a page turn interlocking processor 139, a display magnification specification processor 141, and a brightness & chroma control processor 142.

This player electronic music display 120 receives music data and music display control data signal from the music control unit 200 through the transceiver 121 and stores the downloaded music data stores the music storage block 123 by the music data storage processor 122. The music data edition processor 124 reads music data from the music storage block 123 by a music display control data signal and edits it to a music data to be displayed. The display processor 126 converts the music data into music image data. The 3-state bus driver processor 127 controls the brightness and chroma of the music image data and displays it on the music display unit 128. The music data edition processor 124 works in response to the music display control data signal from the music control unit 200, commands from the command input display block 129 and commands from the page turning foot switch 131.

Said music storage processing blocks 122 to 123, said 3-state bus driver processor 127, and processing blocks from said input processor 132 to said brightness & chroma control processor 142 are made up with small computer systems.

There are two kinds of music data to be downloaded from the music control unit 200: Score (all music parts) and music data for each part. These kinds of music data are selectable. Therefore, while the score data is downloaded into the music storage block 123, the music data edition processor 124 edits music data of each play part by classifying the music data of each play part by the part data distribution processor 125.

The input processor 132 enters a music display control data signal from the page turning foot switch 131 and the switch display button of the input display block 129. The decoder analyzes the signal and distributes the signal according to the content of the control data signal to the Previous/Next page specification processor 134, the arbitrary page specification processor 135, the paragraph number specification processor 136, the Auto/Manual change-over processor 137, the Download/Play change-over processor 138, the page turn interlocking processor 139, the display magnification specification processor 141, and the brightness & chroma control processor 142.

In the Page Turn Interlocking mode, the transceiver 121 transmits the processing results (page turn data) of the Previous/Next page specification processor, the arbitrary page specification processor, and the paragraph number specification processor to the other player electronic music displays.

Figure 4:
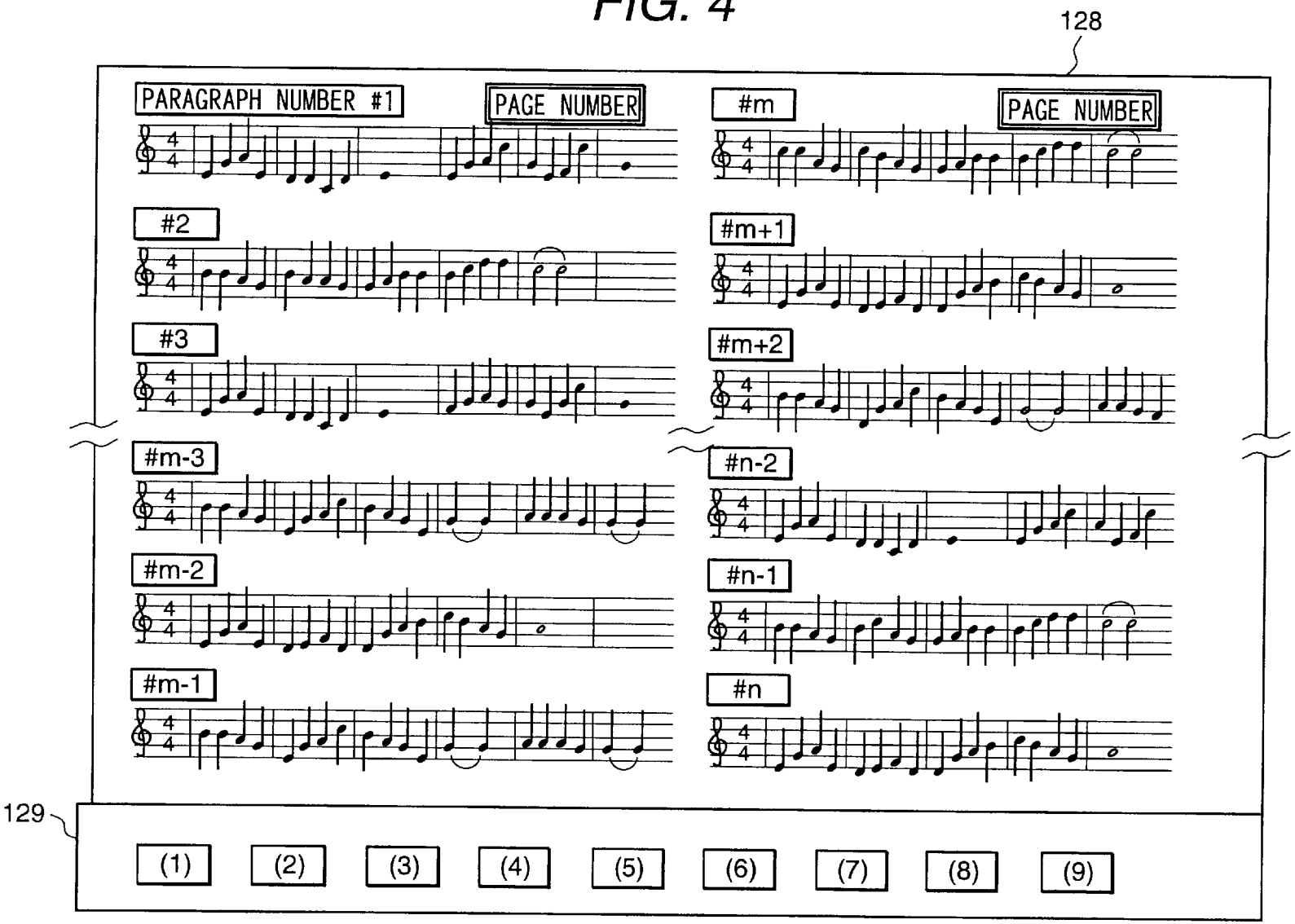
FIG. 4 is a layout of the music display screen of a player electronic display unit in the electronic music providing apparatus of FIG. 1.

FIG. 4 is a sample music display screen of a player electronic display unit 120. The screen layout of the player electronic display unit 120 is the same as that of the manager electronic display unit 110. The screen comprises two areas: a command input display area 129 at the bottom of the screen and a music display area 128 in the other part of the screen. The player can enter a command by touching a related switch button in the command input display area 129.

Switch buttons in the command input display area 129 are assigned functions as follows:

The switch button (1) commands to display the previous music page. This button is used to display back a music page in music practice.

The switch button (2) commands to turn music pages to display an arbitrary music page.

The switch button (3) commands to display a music page containing a selected paragraph number.

The switch button (4) commands to switch between Auto and Manual modes. The user presses this switch to set the Auto mode to make the loaded music data only for a related music part or to set the Manual mode to store the loaded music data and display it on the screen.

The switch button (5) commands to switch between Download mode (to download and store music data) and Play mode (to display the stored music).

The switch button (6) commands to interlock the player electronic music displays in charge of the same play part with each other to turn pages simultaneously.

The switch button (7) commands to set a power of magnifying music on-screen for legibility (according to the eyesight of the player and the complexity of music).

The switch button (8) commands to control the brigtness and chroma of the display screen.

The switch button (9) commands to display the next music page.

Figure 5:
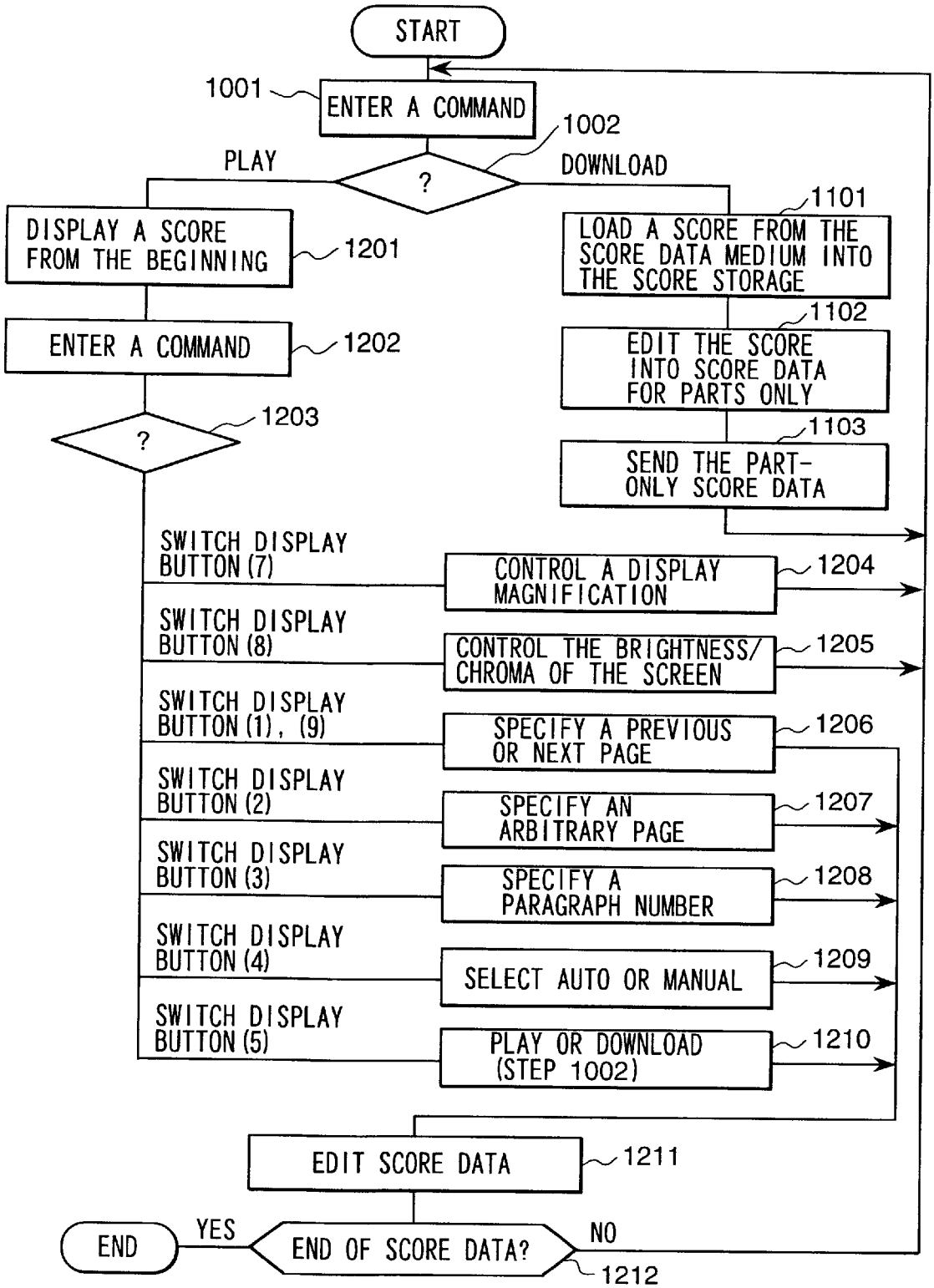
FIG. 5 is a control flow chart of the music control unit in the electronic music providing apparatus of FIG. 1.

Referring to FIG. 5, the control process of the display control unit 200 will be explained below.

Step 1001

The display control unit 200 inputs a command from the input display block 111.

Step 1002

The display control unit 200 analyzes the command from the switch button (5) and sets the Download mode or the Play mode.

Step 1101

In the Download mode, the display control unit 200 gets score data from a music data medium 300 and stores it in the score memory block 210.

Step 1102

The display control unit 200 loads music data of each play part from the music storage block 210, assigns ID information to each piece of music data, and edits it into music data for each play part only.

Step 1103

The display control unit 200 edits the music data of each play part only (music data of each play part and ID information) into a transmission data format and transmits the result.

Step 1201

In the Play mode, the display control unit 200 reads score data (from the beginning) from the music storage block 210 and displays it on the music display unit 112.

Step 1202

The display control unit 200 inputs commands from the command input display block 111 and the page turning foot switch 112.

Step 1203

The display control unit 200 analyzes the command input and sends control to the next step.

Step 1204

When the switch button (7) is pressed in the initial stage, the display control unit 200 controls the magnifying power of the screen.

Step 1205

When the switch button (8) is pressed, the display control unit 200 controls the brightness and the chroma of the screen.

Step 1206

When the switch button (1) or (9) is pressed, the display control unit 200 starts the Previous/Next page specification processor.

Step 1207

When the switch button (2) is pressed, the display control unit 200 starts the arbitrary page specification processor.

Step 1208

When the switch button (3) is pressed, the display control unit 200 starts the paragraph number specification processor.

Step 1209

When the switch button (4) is pressed, the display control unit 200 starts the Auto/Manual change-over processor. The display control unit 200 automatically processes music for each play part when "Auto" is set or processes music of a selected part when "Manual" is set.

Step 1210

When the switch button (5) is pressed, the display control unit 200 returns control to the step 1002 to download music or to the music control processing.

Step 1211

The display control unit 200 edits music data by the processors started in steps 1206 to 1209.

Step 1212

The display control unit 200 returns control to the step 1202 when music data is left unprocessed or ends processing when there is no music data to be processed.

Figure 6:
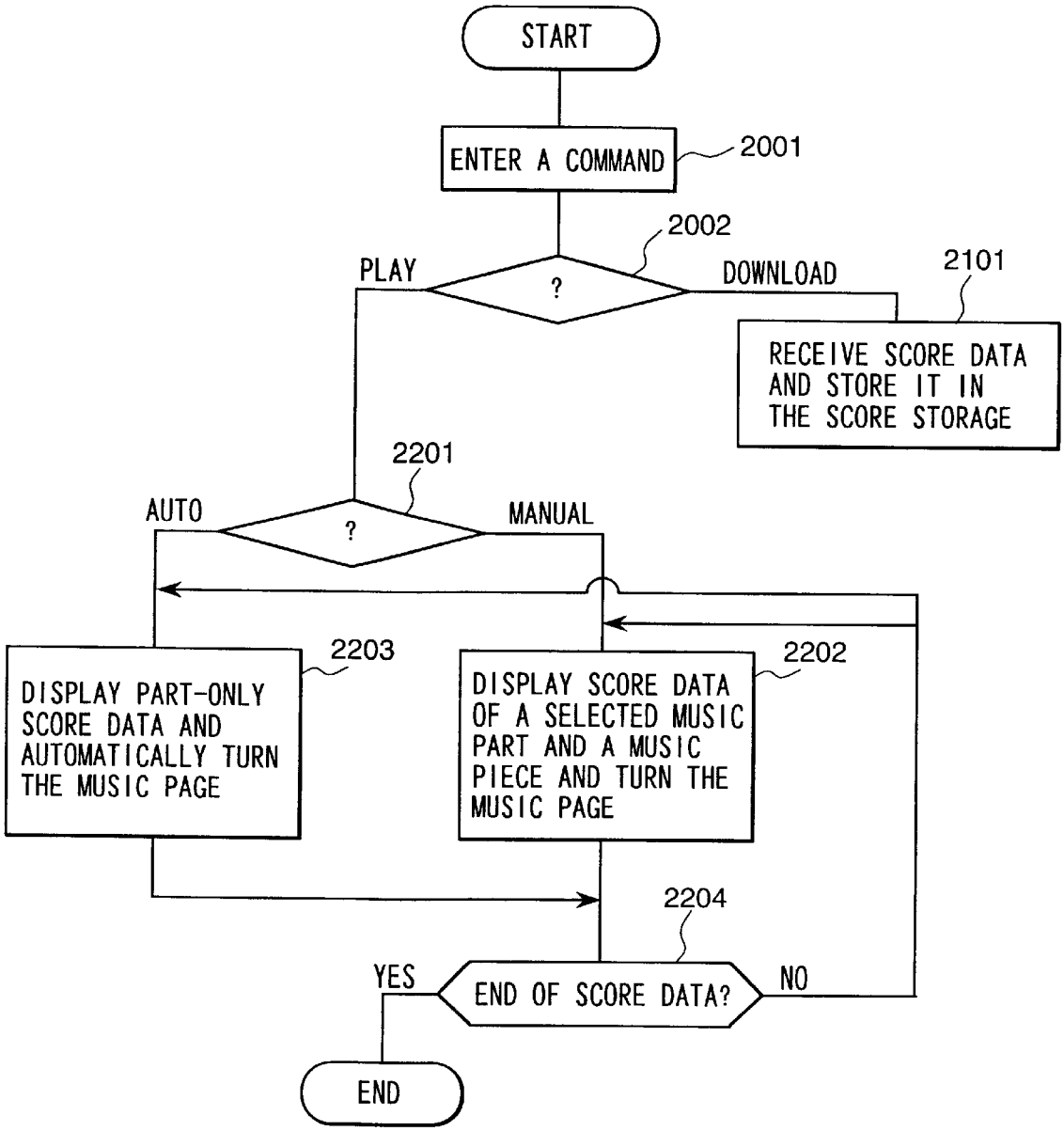
FIG. 6 is a control flow chart of the player music control unit in the electronic music providing apparatus of FIG. 1.

Referring to FIG. 6, below will be explained a control processing of the player electronic music display unit 120.

Step 2001

The display control unit 200 inputs a command from the command input display block 129.

Step 2002

The display control unit 200 analyzes the command input from the switch button (5) and sets the Download mode or the Play mode.

Step 2101

When the Download is selected, the display control unit 200 checks the setting of the switch button 4. When the switch button 4 sets "Auto," the display control unit 200 isolates part-dedicated music data of the selected music part, and stores it in the music storage block 123. When the switch button 4 sets "Manual," the display control unit 200 receives all music data (score data) and stores it in the music storage block 123.

Step 2201

When the Play mode is selected, the display control unit 200 checks the setting of the switch button 4 and branches control according to the setting.

Step 2202

When the switch button 4 sets "Manual," the display control unit 200 reads music data of a selected music part from the score data stored in the music storage block 123, displays it on-screen, and implements page-turning processing according to the switch button setting on the command input display block 129 and a command input from the page turning foot switch 131.

Step 2203

When the switch button 4 sets "Auto," the display control unit 200 reads part-dedicated music data from the music storage block 123 and displays it on-screen. When the switch button 6 sets "Page Turn Interlocking," the display control unit 200 implements music display control processing in response to score display control data signals sent from the music control unit 25 and player electronic display units of the same part 130, 140, and so on. In other words, when receiving a music display control data signal (with respect to the score) from the music control unit 25, the display control unit 200 converts it into a music display of the related play part, and turns music pages to display the same music page as that on the manager electronic display unit 110. When receiving a music display control data signal of each part by operation of the command input display area 129 of any player electronic music unit (130, 140, . . . ) of the music part or by operation of the page turning foot switch 131 from the player electronic music unit (130, 140, . . . ), the display control unit 200 implements page turning according to this music display control data signal of each part. It is preferable to select one of the player electronic music units 120, 130, 140, and so on of an identical play part and cause it to transmit this music display control data signal of each part.

Step 2204

The display control unit 200 returns control to the steps 2202 and 2203 when music data is left unprocessed or ends processing when there is no music data to be processed.

This embodiment transmits the whole music data to each player electronic music display unit (120, 130, 140, and so on) and causes electronic music display unit to store it in advance. In the Play mode, the embodiment transmits only music display control data signals to display a selected music page. However, it is also preferable to transmit a related music part (page) to each player electronic music display unit when page turning is required.

Further, it is also preferable to use not only a radio transmission but also a cabled transmission to transfer music data and music display control data signals.

The above mentioned invention can provide an electronic music providing apparatus which can show adequate music for each of music players such as orchestra members. Particularly, the electronic music providing apparatus in accordance with present invention can facilitate provision of music data for a log of music display units and update (page turning) of music pages on-screen during playing.

Below will be explained another embodiment of the present invention referring to accompanying drawings. The electronic music providing apparatus which is an embodiment of the present invention is preferable as an electronic music display unit in the electronic music providing apparatus which is explained in the specifications and drawings of the Japan Patent Publication 2000-367329.

FIG. 7 is a functional block diagram of an electronic music providing apparatus which is another embodiment of the present invention. The control processor in this electronic music providing apparatus is a flat personal computer comprising a liquid crystal display panel of the touch-sensitive type and a radio transceiver and loads a control program into the personal computer. The processing blocks in the electronic music providing apparatus carry out processing upon implementation of said control program.

One electronic music providing apparatus 2100 comprises a flat personal computer as an electronic display unit 2001 and a pair of page turning switches 2002A and 2002B. These two switches are respectively placed on either side of an instrument so that the switches may be operated to turn music pages by both hands of the player. When a player's foot is used to turn pages, one of the page turn switches 2002B is omitted.

The electronic display unit 2001 comprises a liquid crystal display panel of the touch-sensitive type as an image display block 2011 and operation switches 2012. The electronic display unit 2001 also has a stand 2013 to support the image display block 2011 at a proper height and orientation. Further, the electronic display unit 2001 contains a control processor 1400.

Said player electronic display unit uses a built-in rechargeable battery or an a.c. commercial power source. Further, said player electronic display unit can be so constructed to be connected to a portable battery pack 1500.

The control processor 1400 comprises a music data storage block 1410, an operation input block 1420, a transmission processor 1430, an operation data discriminator 1440, a processing setter 1450, a music data edition processor 1460, a display processor 1470, a turning edition processor 1480, and a common memo transmission/reception edition processor 1490.

The music data storage block 1410 comprises a disk storage unit 1411, a music data storage processor 1412, and a storage unit 1413. The music data storage block 1410 reads music data from a music storage disk (magnetic storage disk or optical storage disk) installed in a disk drive unit or music data which the transmission processor 1430 received, assigns storage address to each movement of the music data by the music data storage processor 1412, and stores music data by part in the storage unit 1413. The music storage disk 1414 as the music data storage medium can be substituted by a memory card (compact flush memory or PC card). When a memory card is used as the music data storage medium, the disk drive unit 1411 is substituted by a memory card slot.

The operation input block 1420 comprises an operation input processor 1421, page turn signal input terminals 1422*a* and 1422*b*. The operation input processor 1421 receives operation signals from the touch-sensitive panel on the image display block 2011 of the electronic display unit 2001 and operation switches 2013 and page turn signals from the page turning switches 2002A and 2002B. The two page turn input terminals 1422*a* and 1422*b* enable connection of the two page turning switches 2002A and 2002B if necessary, OR them and connect the result to the operation input processor 1421.

The transmission processor 1430 comprises a transceiver 1431 and an antenna 1432 and transfers music data and memo data to and from the music control unit and the other electronic music providing apparatus which have been explained in the specifications and drawings of the Japan Patent Publication 2000-367329.

The operation data discriminator 1440 discriminates an operation input signal which is output from the operation input block 1420.

The processing setter 1450 comprises a previous/next page specification processor 1451, an arbitrary page specification processor 1452, a play order registration processor 1453, a common/private memo hierarchy processor 1454, and a page turning parameter registration processor 1455. The previous/next page specification processor 1451 specifies backward or forward page turning to a specified page according to a page turn signal (to be explained later). The arbitrary page specification processor 1452 specifies jumping to a specified page according to a page turn signal. The play order registration processor 1453 extracts a music piece to be played (provided) from music data stored in the music data storage block 1410, and registers the playing order of the selected music pieces according to a command signal. The common/private memo hierarchy processor 1454 receives hand-written memo data from a touch-sensitive input panel which is a memo input means, classifies the memo data into common memo data and private memo data, and sets processing to handle them on different hierarchical levels (for example, the first level for music data, the second level for common memo data, and the third level for private memo data). The page turning parameter registration processor 1455 processes to register page turning control parameters (to be explained later).

The music data edition processor 1460 transfers the common memo data to the common memo transmission/reception edition processor 1490 according to the result of processing of the processing setter 1450 when a command to send common memo data. Further the music data edition processor 1460 gets music data of a target page from the music data storage block 1410 according to page turn signals, transfers it together with the page turn control parameters to the display processor 1470, gets common memo data from the common memo transmission/reception edition processor 1490, and transfers it to the display processor 1470.

The display processor 1470 transfers music data and the page turn control parameters to the turning edition processor 1480, gets edited music data from the turning edition processor 1480, expands it together with memo data into image data, and supplies the result to the image display block 2011 to display it on-screen.

The turning edition processor 1480 comprises an update ratio change block 1481, an update delay time control block

1482, a piece order display indication block 1483, and a piece order control block 1484. The update ratio change block 1481 changes the division ratio of music to be updated according to the update ratio set by a page turn control parameter. The update delay time control block 1482 controls the delay time (update time difference) of music to be updated (the latter half of the divided update music) according to the update delay time set by a page turn control parameter. The piece order display indication block 1483 shows a list of music pieces to be played and a music registration table for registration of a playing order of music pieces by the play order registration processor 1453. The piece order control block 1484 checks the playing order of music pieces which was registered for a double order registration or an invalid order, displays an input error when finding a registration error or an invalid music piece, and displays the top page of the next music piece next to the last page of the currently-displayed page when the last page of the current music is complete.

The common memo transmission/reception edition processor 1490 receives common memo data from the music data edition processor 1460, edits it into a transmission format, and sends the result to the transmission processor 1430. The common memo transmission/reception edition processor 1490 also receives common memo data from the transmission processor 1430, edits it into a display format, and transfers the result to the music data edition processor 1460. In this transfer of common memo data, the common memo data is edited into such a format that is available to a conductor and a section leader before transmission but not edited into such a format that is available to a player. The incoming common memo data edited so as to be available to the conductor is given a memo identification code so that it may be received and displayed by all electronic music providing apparatus that all players in the orchestra use. Similarly, the incoming common memo data edited so as to be available to the section leader is given a memo identification code so that it may be received and displayed by the electronic music providing apparatus that are available to players of an identical music instruments. The electronic music providing apparatus that are available to players are constructed to read said memo identification codes, fetch the related common memo data, and display it.

The page turning switches 2002A and 2002B respectively have a Previous Page switch (2002Aa or 2002Ba) and a Next Page switch (2002Ab or 2002Bb). These Previous and Next Page switches are connected to a plurality of electronic display units so that the page turn signals may be sent to them simultaneously. It is very convenient to use a short-distance radio transmission which employs radio waves as transmission media to transfer the page turn signals between the electronic music display units 2001 and the page turn switches 2002A and 2002B when the page turn signals are transferred from one pair (or more pairs) of the turn page switches 2002A and 2002B to a plurality of electronic music display units 2001.

The other electronic music providing apparatus 2200 is constructed in the similar manner. However, if the electronic music providing apparatus 2200 is provided in parallel and interlocked with said electronic music providing apparatus 2100 and a single player uses these electronic music providing apparatus, the pair of the page turn switches 2002A and 2002B of the electronic music providing apparatus 2100 is shared by the electronic music providing apparatus 2200. The electronic music providing apparatus 2100 and 2200 divide music so that they may display consecutive different music pages.

The electronic music providing apparatus 2100 which is constructed in this manner basically stores and retains music data of some music pieces in the music data storage block 1410. The processing setter 1450 or the music data edition processor 1460 reads music data of a music piece to be played out from the music data storage block 1410 by a command signal from the electronic music display unit 2001 or the page turn switch 2002A or 2002B and sends it to the display processor 1470 so that it may be displayed on the image display block 2011 of the electronic display unit 2001 and music pages may be turned.

Figure 8:
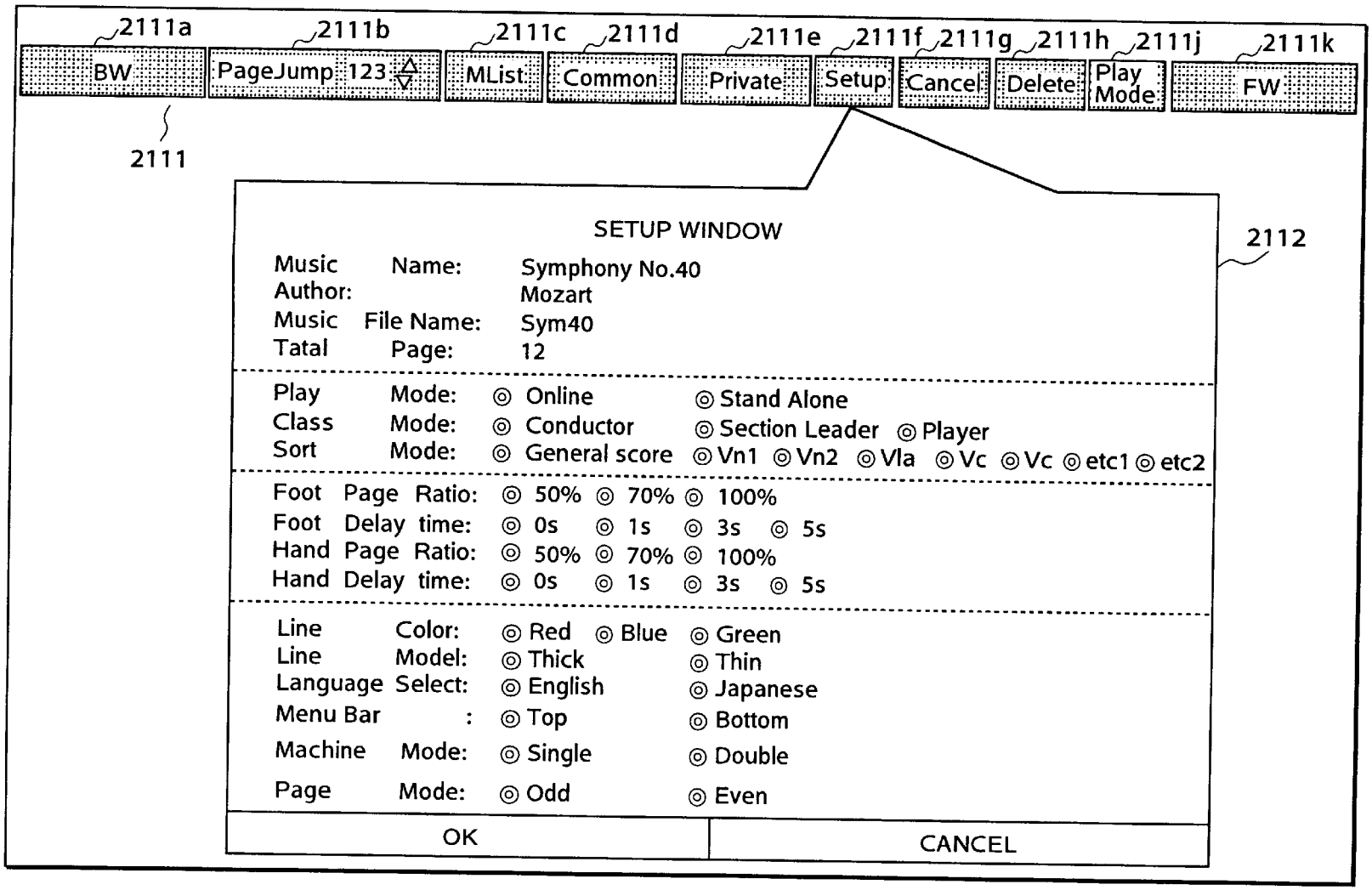
FIG. 8 is a layout of the initial setting window used for setting and registration of page turn control parameters which are processed by the control processor of the electronic music providing apparatus of FIG. 7.

When the POWER switch which is one of the operation switches 2012 of the electronic display unit 2001 is turned on, the turning parameter registration processor 1456 of the control processor 2014 shows an initial screen (see FIG. 8) on which page turn control parameters are set and registered.

This initial setting screen shows a parameter registration table window 2112 which contains a menu bar 2111 and update-related information to be set and registered. This initial setting appears on screen also when the "Setup" button of the menu bar 2111 is touched while the SETUP window is on-screen. The menu bar 2111 is always displayed on screen while the POWER switch of the electronic display unit 2001 is on.

The menu bar 2111 contains various menu buttons. They are BW (Previous Page) 2111*a*, Page Jump (To a Selected Page) 2111*b*, MList (List of Music Pieces) 2111*c*, Common (Common Memo) 2111*d*, Private (Private Memo) 2111*e*, Setup (Initial Setting) 2111*f*, Cancel 2111*g*, Delete 2111*h*, Play Mode (Operating Mode) 2111*j*, and FW (Next Page) 2111*k*.

The BW (Previous Page) button 2111*a* commands page turning to call the previous music page. The Page Jump (To a Selected Page) button 2111*b* commands page turning to call a specified music page. The MList (List of Music Pieces) button 2111*c* commands page turning to call a screen for registering music pieces and their playing order. The Common (Common Memo) button 2111*d* commands to enter and register common memo data. The Private (Private Memo) button 2111*e* commands to enter and register private memo data. The Setup (Initial Setting) button 2111*f* commands to call the Initial Setting window. The Cancel button 2111*g* commands to cancel an entered command. The Delete button 2111*h* commands to delete an entered command. The Play Mode (Operating Mode) button 2111*j* commands to select an operating mode (Network or Single). The FW (Next Page) button 2111*k* commands page turning to call the next music page.

The BW (Previous Page) button 2111*a* and the FW (Next Page) button 2111*k* function as manual page turning switches.

The whole display screen area of the image display unit 2011 including the music display area is made up with a liquid crystal display unit of a touch-sensitive panel type. The music display area or whole display screen of the image display unit 2011 can be divided into two left and right switch areas so that the user can turn music pages by touching these switch areas on the screen. When the user touches the left switch area on the screen, this area generates a previous page signal like the BW (Previous Page) switch 2111*a*. Similarly, when the user touches the right switch area, this area generates a next page signal like the FW (Next Page) switch 2111*a*. This is one of the convenient configuration samples.

It is also possible to divide the display screen into two vertical areas to have upper and lower page turning switch areas. However, it is more preferable to divide the display screen into two horizontal areas to have left and right page turning switch areas.

The parameter registration table window 2112 contains information pertaining to music pieces to be set as page turning control parameters (Music Name, Author, Music File Name, and Total Page), a registration table to set Play Mode, Class Mode, Sort Mode, Foot Page Ratio, Foot Delay Time, Hand Page Ratio, Hand Delay Time, Line Color, Line Model, Language Select, Menu Bar, Machine Mode, and Page Mode, the OK button and the CANCEL button.

As "Play Mode," select "Online" to use the electronic music providing apparatus in connection to a network or "Stand Alone" to use the electronic music providing apparatus alone. As "Class Mode," select a person (Conductor, Section Leader, or Player) who uses the electronic music providing apparatus. When "Conductor" or "Section Leader" is selected as a class mode, the electronic music providing apparatus can transfer hand-written common memo data to the other electronic music providing apparatus. When "Player" is selected, the electronic music providing apparatus can singly enter hand-written private memo data (to store and display). As "Sort Name," select a kind (section) of a music instrument to be played. As "Foot Page Ratio," select a ratio (in percentage) of the music display area (music) to be updated as a former half of music (to the whole display area) when a page turn signal comes from the foot switch (a foot-operated page turning switch). As "Foot Delay Time," select a time delay (an update time difference) to be put before the latter half of the music display area is updated after a page turn signal comes from a foot switch (a foot-operated page turning switch). As "Hand Page Ratio," select a ratio (in percentage) of the music display area (music) to be updated as a former half of music (to the whole display area) when a page turn signal comes from the hand switch (a manual page turning switch). As "Hand Delay Time," select a time delay (an update time difference) to be put before the latter half of the music display area is updated after a page turn signal comes from a hand switch (a manual page turning switch). As "Line Color," select a color (Red, Blue, or Green as a display color) of characters of hand-written memo data. As "Line Model," select a thickness (Thick or Thin) of lines of hand-written memo characters. As "Language Select," select a language in which items of the menu bar 2111 and the parameter registration table 2112 are written. As "Menu Bar," select a location (Top or Bottom) in the image display area on which the menu bar 2111 is displayed. As "Machine Mode," select whether the electronic display unit 2001 is used singly (Single) or doubly (Double). As "Page Mode," select a type of page turning (Odd or Even) of the image display area 2011 of each electronic display unit 2001 when two electronic display units are used. (For example, the left electronic display unit 2001 shows an odd-numbered page of a music piece and the right electronic display unit 2001 shows an even-numbered page of a music piece.) When "Single" is selected as "Machine Mode," music pages are turned consecutively. The OK button is used to register the setting of the above parameters and the CANCEL button is used to cancel the above setting.

Figure 9:
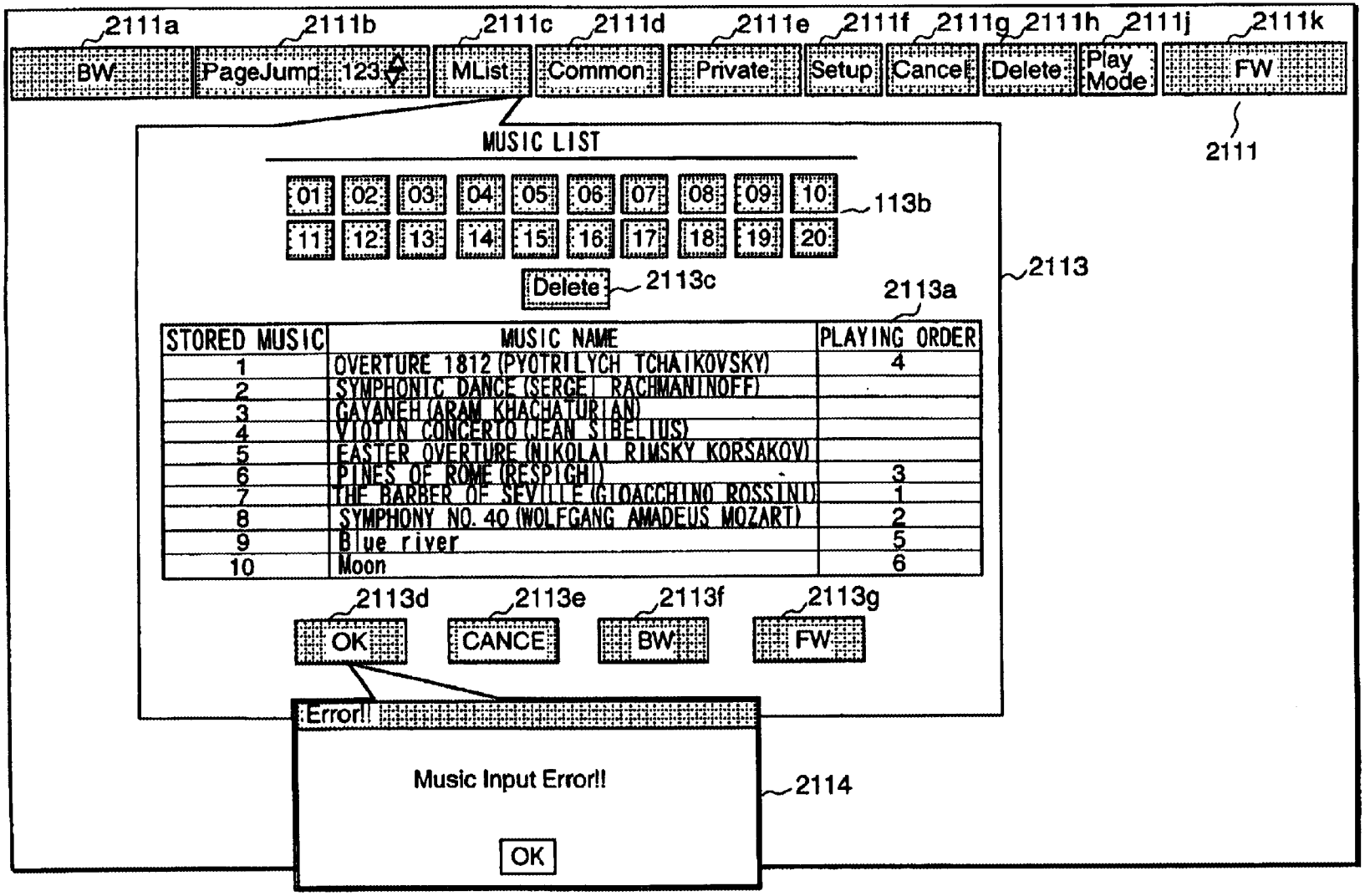
FIG. 9 is a music list registration window used for setting and registration of music pieces and their playing orders which are executed by the control processor of the electronic music providing apparatus of FIG. 7.

When the MList (List of Music Pieces) button 2111*c* is touched, the play order registration processor 1453, the piece order display indication block 1483, and the piece order control block 1484 of the control processor 14 respectively show a music list registration window (see FIG. 9) and implement processing to set and register a list of music pieces to be played and their playing order.

The music list registration window 2113 contains a music list 2113*a*, buttons 2113*b* for setting a playing order, a Delete button 2113*c* (for deletion), an OK button (for registration) 2113*d*, a CANCEL button 2113*e* (for cancellation), a BW (Previous Page) button 2113*f* and an FW (Next Page) button 2113*g*.

The music list 2113*a* shows a listing of music pieces and enables setting of an order of playing music pieces. The buttons 2113*b* for setting a playing order are respectively used to set the playing order of a touch-selected music piece. The Delete button 2113*c* (for deletion) is used to delete the setting of a playing order of a selected music piece. When the user touches the OK button (for registration) 2113*d*, the piece order control block 1484 works to check the setting. When finding any setting error such as a missing or duplicated order number, the piece order control block 1484 displays a "Music input error" window 2114 without registering the setting. When the setting is valid, the piece order control block 1484 selects the first music piece to be played and displays its music. The CANCEL button 2113*e* is used to cancel the entered playing order. The BW (Previous Page) button 2113*f* is used to display back the previous music list page 2113*a*. The FW (Next Page) button 2113*g* is used to display the next music list page 2113*a*.

Figure 10:
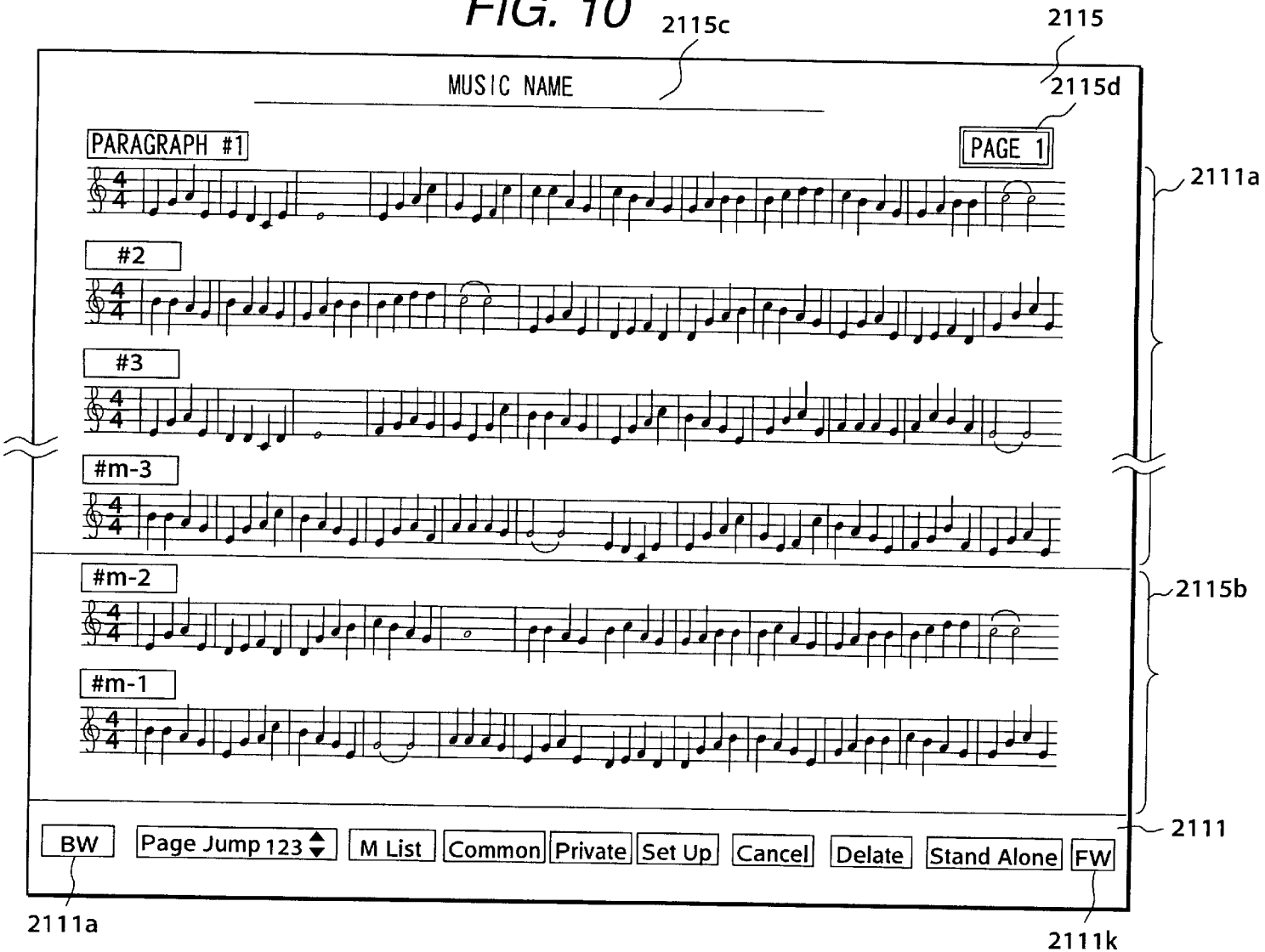
FIG. 10 is a music list window for music control which is displayed by the control processor of the electronic music providing apparatus of FIG. 7.

FIG. 10 shows a music control window 2115 (for music practice) of displayed on the image display area 2011 of the electronic music display unit 2001. FIG. 10 assumes the following parameter setting: "Stand Alone" play mode, "Player" class mode, Foot page ratio of 70%, Foot delay time of 3 seconds, Hand page ratio of 70%, Handy delay time of 0 second, menu bar 2111 on the bottom of the screen, and "Single" machine mode.

This music control window 2115 shows the former part (70%) of music of page 1 on the upper display area 2115*a* and the latter part (30%) of music of page 1 on the lower display area 2115*b*. This control window 2115 also shows the title of a music piece 2115*c* and the current music page 2115*d*.

The numbers of paragraphs on music papers are various (depending upon music companies). However, it is basic that each music page is always delimited by a rest symbol on the lower right corner of the music page (the final music page viewed by the player). This is to eliminate an influence due to a page turning break. Therefore, if the music page has less or no rest symbol, the bar break is provided in a place having less notes.

This invention enables page turning even on a place having no rest. So each music page can have legible bars according to the size of the screen. For example, a screen page smaller than the portrait-oriented JIS B4 paper size can have 10 to 12 paragraphs (preferable) on the music page. Similarly, a screen page smaller than the landscape-oriented JIS B4 paper size can have 5 to 6 paragraphs (preferable) on the music page.

Figure 11:
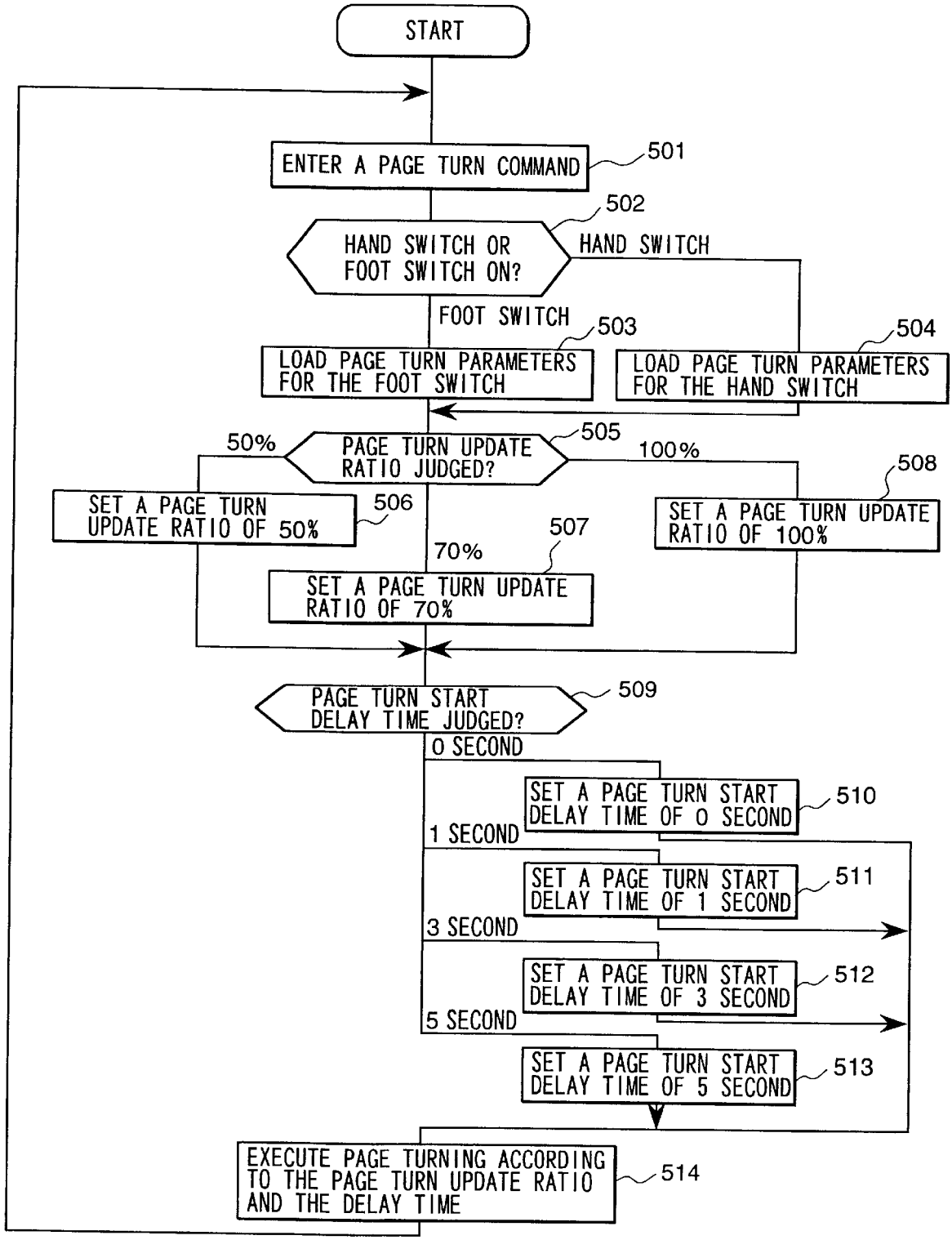
FIG. 11 is a flow chart of page turn control processing which is implemented by the control processor of the electronic music providing apparatus of FIG. 7.

Referring to FIG. 11, below will be explained how page turning is implemented when a page turn signal generates.

Step 501

A page turn signal generated by the electronic music display unit 2001 or a page turn switch 2002A or 2002B is sent to the Previous/Next page specification processor 1451 through the operation input processor 1421 and the operation data discriminator 1440.

Step 502

The previous/Next page specification processor 1451 analyzes the incoming page turn signal, identifies it (a page turn signal from the page turn switch 2002A or 2002B or a page turn signal from the BW button 211*a* or the FW button 2111*k* on the menu bar of the electronic music display unit 2001) and branches it to a related block.

Step 503

When the page turn signal is coming from a page turn foot switch 2002A or 2002B, the page turning parameter registration processor 1455 gets the values of the Foot Page Ratio (foot-operated update ratio) and Foot Delay Time (foot-operated update time difference) parameters which were set on the parameter registration table window 2112.

Step 504

When the page turn signal is coming from the BW button 2111*a* or the FW button 2111*k*, the page turning parameter registration processor 1455 gets the values of the Hand Page Ratio (hand-operated update ratio) and Hand Delay Time (hand-operated update time difference) parameters which were set on the parameter registration table window 2112.

Step 505 to 508

The obtained and discriminated update ratio is sent to the update ratio change block 1481 of the turning edition processor 1480 through the music data edition processor 1460 and the display processor 1470.

Step 509 to 513

The obtained and discriminated update delay time is sent to the update delay time control block 1482 of the turning edition processor 1480 through the music data edition processor 1460 and the display processor 1470.

Step 514

The turning edition processor 1480 edits music data according to the update ratio and the update delay time which were set by the update ratio change block 1481 and the update delay time control block 1482, sends the result of the edition to the display processor 1470, converts it into music image data and displays it on the display processor 2011 of the electronic music display unit 2001. Thus the page turning is attained. In this example, when the page turn signal is coming from a page turn foot switch 2002A or 2002B, the former half 2115*a* (70% of music displayed) is updated when a page turn signal is entered and the latter half 2115*b* (30% of music) is updated three seconds after the page turn signal is entered. When the page turn signal is coming from the BW (Previous Page) button 2111*a* or the FW (Next Page) button 2111*k*, the whole music on screen is updated at once (without any update time difference) when a page turn signal is entered.

When using two electronic music display units 2001 in combination, select "Double" as "Machine Mode" and select "Odd" (odd-numbered page turning) as "Page Mode" for one of the electronic music display units 2001 and "Even" (even-numbered page turning) as "Page Mode" for the other. (With this, the left electronic display unit 2001 shows an odd-numbered page of a music piece and the right electronic display unit 2001 shows an even-numbered page of a music piece.) In Step 514 under this condition, one of the electronic display units 2001 turns odd-numbered pages only and the other electronic display unit 2001 turns even-numbered pages only.

Figure 12:
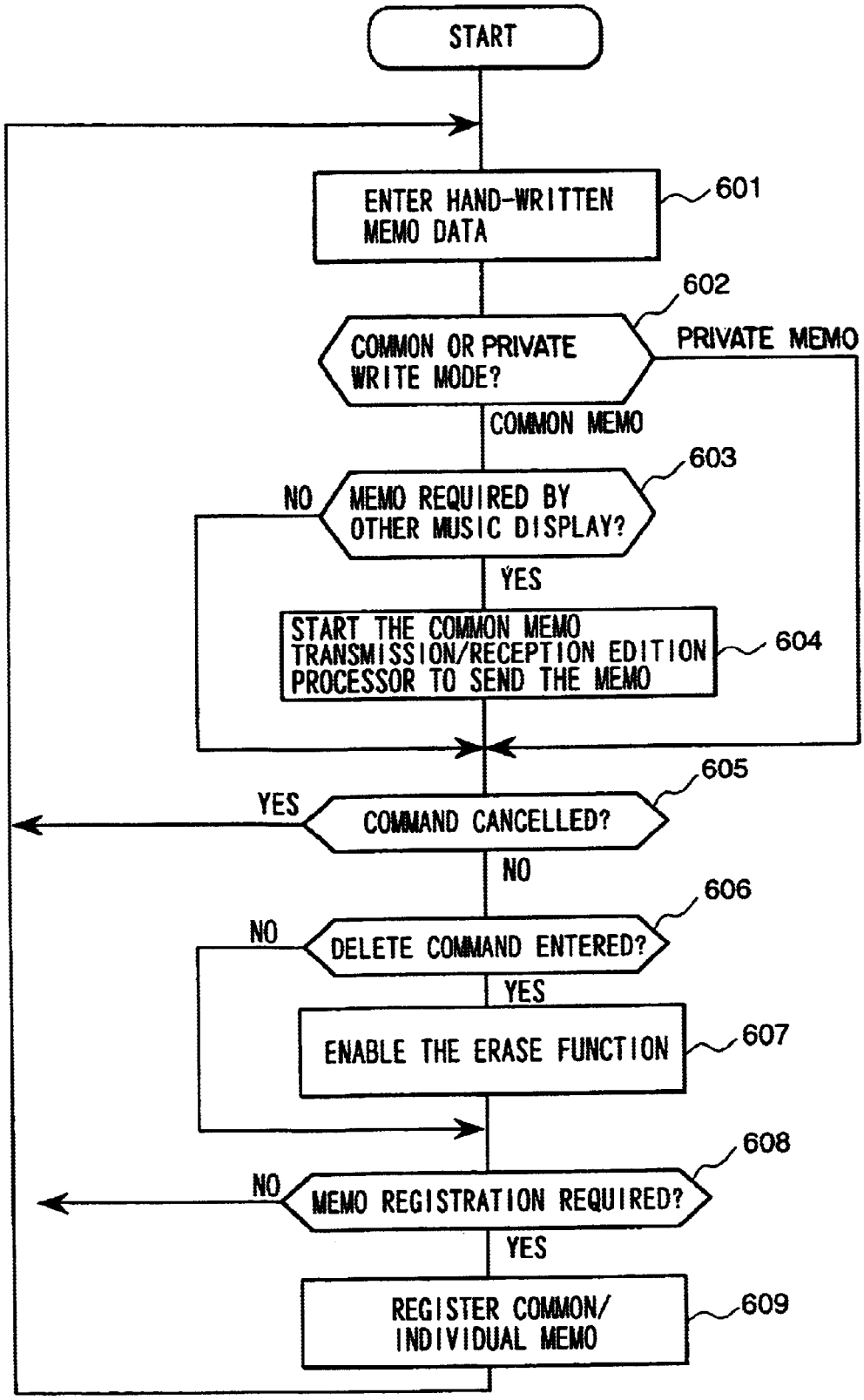
FIG. 12 is a flow chart of hand-written memo data processing which is implemented by the control processor of the electronic music providing apparatus of FIG. 7.

Referring to FIG. 12, below will be explained how hand-written memo data will be explained.

Step 601

A page turn signal generated by touching the Common (Common Memo) button 2111*d* or the Private (Private Memo) button 2111*e* is sent to the processing setter 1450 through the operation input processor 1421 and the operation data discriminator 1440. With this signal, the Common/Private memo hierarchy processor 1454 starts and is ready to enter hand-written memo data in the operating (Common or Private) mode. In this status, the user can enter hand-written memo data from the touch-sensitive panel of the image display unit 2011.

Step 602

The operation data discriminator 1440 judges whether the entered hand-written memo data is common or private memo and branches the memo data to the related block.

Step 603

When the entered hand-written memo data is common memo data, the operation data discriminator 1440 checks the setting of the "Class Mode page turn control parameter and branches control to the related block, considering whether the memo data must be sent to the other electronic music display unit. When "Conductor/Section Leader" is selected as "Class Mode," the control processor transmits the hand-written common memo data to the other electronic music providing apparatus. When "Player" is selected as "Class Mode," the control processor receives hand-written private memo data (to store and display).

Step 604

When "Conductor" or "Section Leader" is selected as "Class Mode," the common memo transmission/reception edition processor 1490 starts to edit the common memo data into a transmission format, and sends the result to the transmission processor 1430 to transmit it. The common memo data transmitted by the electronic music display unit of the "Conductor" class mode is received by all player electronic music display units and displayed there. The common memo data transmitted by the electronic music display unit of the "Section Leader" class mode is received by all electronic music display units of the same sort name and displayed there.

Step 605

The operation data discriminator 1440 checks for a signal from the Cancel button 2111*g*, branches control to the related block when the Cancel signal is not entered or returns control to Step 601 when the Cancel signal is entered.

Step 606

The operation data discriminator 1440 checks for a signal from the Delete button 2111*h*, and branches control to the related block.

Step 606

When a signal is entered from the Delete button 2111*h*, the control processor enables the erase function to delete the hand-written memo data.

Step 607

While the control processor is ready to receive hand-written memo data, the generation of a signal by the Common (Common Memo) button 2111*d* or the Private (Private Memo) button 2111*e* is monitored together with a memo data registration signal.

Step 607

When the Common (Common Memo) button 2111*d* or the Private (Private Memo) button 2111*e* is touched to generate a signal in the Ready status, the entered hand-written memo data is registered.

Not referring to a drawing, the following will be explained. When the user select a destination page and touches the Page Jump (To a Selected Page) 2111*b*, the arbitrary page specification processor 1452 starts to set page turning to display the selected page. With this, the music data edition processor 1460, the display processor 1470, and the turning edition processor 1480 turn pages to display the selected page.

Not referring to a drawing, the following will be explained. A display orientation switch is provided as one of the operation switches 2012 in the image display area 2011 of the electronic music display unit 1 to generate a signal to orient a music page relative to the image display area 2011. The display processor 1470 orients (rotates) the music page on the image display area 2011 in response to a signal from the display orientation switch.

As the supplemental explanation of the music display screen, the area to display a half of a music page should be as big as the JIS B4 size as general music pages are of the JIS B3 size. So on the display screen of the JIS A4 (10.5 inches) or B4 size or smaller, the present invention can perform A4-size page turning by changing the music update ratio or music display delay.

It is preferable that the battery can work for 2.5 hours to 7.5 hours because each professional concert usually lasts for 2.5 hours to 3.0 hours (including intermissions). Therefore the electronic music providing apparatus is requested to have a battery which can work for such a time period.

Further, a rehearsal for a general concert lasts for 7.5 hours to 8.0 hours including a lunch time. Therefore the user had better select one of two types of batteries (ordinary type and heavy-duty type) according to the concert type (professional or rehearsal) for convenience.

The effects below can be obtained in accordance with the present invention.

The electronic music providing apparatus can turn music pages at a selected update ratio and at a preset time difference. Therefore, the user can implement music page turning according to the playing technique level of the player or player's taste.

The electronic music providing apparatus can send the entered memo data to the other electronic music providing apparatus to display.

The electronic music providing apparatus can select and display music of a next music piece after displaying of music of a current music piece is completed. Therefore, the user can easily display music of a plurality of music pieces in sequence.

The electronic music providing apparatus can implement page turning in response to operation of a plurality of page turn switches. Therefore, the user can easily turn music pages.

Two or more electronic music providing apparatus in combination can respectively display different pages of a music piece (for example, an odd-numbered page for one electronic music providing apparatus and an even-numbered page for the electronic music providing apparatus).

The electronic music providing apparatus can orient music page on-screen for optimum legibility.

What is claimed is:

1. An electronic music providing apparatus comprising:

a music control unit which includes means for storing full music score data;

means for displaying the full music score data;

means for classifying the full music score data according to play parts, for transmission;

means for generating and transmitting a music display control data signal for updating a music page to be displayed; and a plurality of electronic music display units each of which includes a receiver for receiving music score part data from said music control unit;

a storage processor for recording the received music score part data;

a processor for editing the music score part data;

a display processor for displaying the edited music score part data on a screen;

means for receiving the music display control data signal from said music control unit, and for turning the displayed music pages; and a further means for turning displayed music pages.

2. An electronic music providing apparatus in accordance with claim 1, wherein said electronic music display unit further comprises a means which interlocks said electronic music display unit with another electronic music display unit for the same play part to turn displayed music pages simultaneously.

3. An electronic music providing apparatus in accordance with claim 1, wherein said electronic music display unit turns music pages on-screen according to one of a music display control data signal from said music page turning means in said electronic music display unit and the music display control data from said music control unit.

4. An electronic music providing apparatus for displaying a music page from stored music score data stored in a music data storage block on an image display blocks and updating the music pages according to a music display control data signal, said apparatus, comprising:

an update ratio setting block which sets an update ratio for a displayed music page;

an update delay time control block which sets a preset update time difference such that a specified range within the displayed music page is turned when page turn signal is entered and the other range in the displayed music page is turned at the preset later update time, after the page turn signal is entered; and a page turning editing processing block which edits the music score data to be updated at the set update ratio according to the page turn signal, and displays the edited music score at the preset time difference on said image display block.

5. An electronic music providing apparatus in accordance with claim 4, further comprising:

a memo input means which inputs memo data other than music score data;

a common/private data hierarchical processing block which separates the entered memo data from music score data and hierarchically arranges private memo data and common memo data into tree structures;

a common memo edition processing block which edits common memo data to be sent to another electronic music providing apparatus, and a transmission processing block which transmits and receives common memo data.

6. An electronic music providing apparatus in accordance with claim 4, further comprising:

a play order registration processing block which determines and registers an order of playing music pieces;

a music displaying block which displays the registered pieces of music; and a play order control block which checks the playing order of music for duplicate order registration or invalid) orders and shows a top page of music in the next registered order when the last page of the currently-played piece of music comes, by calling the music data from the music data storage block.

7. An electronic music providing apparatus in accordance with claim 4, further comprising a page turning processing block which sets pages to be turned; wherein said page turning editing processing block updates the music page to be displayed on the screen according to the preset page to be turned.

8. An electronic music providing apparatus in accordance with claim 4, wherein:

the music page turning means has a plurality of operation switches; and said page turning editing processing block turns music pages in response to the music page turn signal generated by respective operation switches.

9. An electronic music providing apparatus in accordance with claim 4, further comprising a music page display orientation indicating means which enables changing the music page display orientation relative to said image display block.

10. An electronic music providing apparatus in accordance with claim 4, wherein:

said image display block includes a liquid crystal display panel of the touch-sensitive type, in which the display screen area is divided into two display screen areas; and one of the two screen areas is used as a previous page turning switch which generates a previous page turning signal, and the other screen area is used as a next page turning switch which generates a next page turning signal.

11. An electronic music providing apparatus in accordance with any of claims 4 to 9, wherein said electronic music providing apparatus uses a battery which assures power supply of 2.5 hours to 7.5 hours.

* * * * *

UNITED STATES PATENT AND TRADEMARK OFFICE

CERTIFICATE OF CORRECTION

PATENT NO. : 6,635,815 B2 
DATED : October 21, 2003
INVENTOR(S) : Juichi Kosakaya, Isao Arai and Masumi Kizaki It is certified that error appears in the above-identified patent and that said Letters Patent is hereby corrected as shown below:

Title page,
Item [73], Assignee, change to -- Hitachi Engineering Co., Ltd. --

Signed and Sealed this

Twenty-seventh Day of January, 2004

JON W. DUDAS
*Acting Director of the United States Patent and Trademark Office*